US005502549A

United States Patent [19]

Hart et al.

[11] Patent Number: 5,502,549

[45] Date of Patent: Mar. 26, 1996

[54] ELECTRICALLY BIASED TONER FILTRATION

[75] Inventors: Steven C. Hart; Cyril G. Edmunds; Gerald M. Kryk, all of Webster, N.Y.

[73] Assignee: Xerox Corporation, Stamford, Conn.

[21] Appl. No.: 321,633

[22] Filed: Oct. 11, 1994

[51] Int. Cl.[6] ..... G03G 15/06

[52] U.S. Cl. ..... 355/245; 355/246

[58] Field of Search ..... 355/245, 246, 355/253

[56] References Cited

U.S. PATENT DOCUMENTS

| | | | |
|---|---|---|---|
| 3,448,724 | 6/1969 | Chawda | 355/245 X |
| 4,054,381 | 10/1977 | Bernhard | 355/302 |
| 4,319,832 | 3/1982 | Sakamoto et al. | 355/303 |
| 4,360,944 | 11/1982 | Iwai et al. | 118/652 |
| 4,377,334 | 3/1983 | Nishikawa | 118/658 |
| 4,389,968 | 6/1983 | Satomura | 118/652 |
| 4,561,759 | 12/1985 | Knott | 355/245 |
| 4,690,540 | 9/1987 | Manno | 355/253 |
| 4,752,805 | 6/1988 | Fukae et al. | 355/298 |
| 5,200,788 | 4/1993 | Thayer | 355/298 |
| 5,305,064 | 4/1994 | Trott et al. | 355/245 X |
| 5,345,298 | 9/1994 | Corrigan, Jr. | 355/245 X |

FOREIGN PATENT DOCUMENTS

| | | |
|---|---|---|
| 59-143180 | 8/1984 | Japan . |
| 62-144191 | 6/1987 | Japan . |
| 5-224564 | 9/1993 | Japan . |

*Primary Examiner*—Nestor R. Ramirez
*Attorney, Agent, or Firm*—John S. Wagley

[57] ABSTRACT

An apparatus for filtering contaminants from marking particles within a conduit is provided. The apparatus includes a mover for moving the marking particles in the conduit and a screen positioned adjacent the conduit so that the marking particles pass through the screen. The apparatus also includes an applicator for applying an electrical bias between the mover and the screen to facilitate the passage of marking particles through the screen.

20 Claims, 4 Drawing Sheets

ELECTRICALLY BIASED TONER FILTRATION

The present invention relates to a developer apparatus for electrophotographic printing. More specifically, the invention relates to a filter for filtering toner.

Cross reference is made to the following applications filed concurrently herewith: U.S. application Ser. No. 08/321,632 filed Oct. 11, 1994, entitled "Point of Use Toner Filtration", by S. C. Hart et al. and U.S. application Ser. No. 08/320,723 filed Oct. 11, 1994, entitled "Filament Fiber Development Traps", by T. J. Behe et al.

In the well-known process of electrophotographic printing, a charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as "toner." Toner is held on the image areas by the electrostatic charge on the photoreceptor surface. Thus, a toner image is produced in conformity with a light image of the original being reproduced. The toner image may then be transferred to a substrate or support member (e.g., paper), and the image affixed thereto to form a permanent record of the image to be reproduced. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways.

In the process of electrophotographic printing, the step of conveying toner to the latent image on the photoreceptor is known as "development." The object of effective development of a latent image on the photoreceptor is to convey developer material to the latent image at a controlled rate so that the developer material effectively adheres electrostatically to the charged areas on the latent image.

In an electrophotographic printer as the developer material is transferred to the photoreceptor and eventually to the copy paper, this used toner must be replaced. The electrophotographic printer thus includes a device for replenishing toner from which fresh toner is dispensed into the machine. In earlier copy machines and printers, toner used in the developer unit was replenished by pouring loose toner into a toner container. In using this replenishing method at least two major problems occurred. The first problem was that a portion of the loose toner could either be spilled during filling or the loose toner would form a cloud when filling and settle later. In either case the spilled or settled toner could contaminate the machine or printer and require an expensive service call. The second problem was that contamination could enter the toner container during fill and negatively effect the operation of the machine.

In more recent copy machines and printers, toner used in the developer unit is replenished by exchanging an empty toner resupply cartridge with a new, full cartridge. Many devices have been used to seal the cartridge prior to installation in the machine. These devices and others have been used to maintain the sealed integrity of the copy cartridge during the exchange of an empty cartridge for a full cartridge. The use of cartridges has reduced the problems with spilled and settled toner as well as contamination problems during toner replenishing. To provide for a small compact toner cartridge and to provide for a toner cartridge in which the opening to the cartridge may be easily removed, the toner cartridge typically has a compact shape with a small opening from which the toner is dispensed. While the use of cartridges for the storage and refilling of toner within a machine reduces the contamination encountered during filling, even in the most stringently controlled manufacturing environments, contaminants may enter the toner itself during its manufacture and/or could enter the cartridge during filling at the factory and later progress into the developer housing causing copy quality problems.

The development system, the area of the electrophotographic printer where the developer material is transferred to the photoreceptor, typically includes a wide area extending across the full width of the photoreceptor in order that a full image width may be developed. The toner must thus progress from the toner container into the developer housing and progress along the full width of the developer housing in order that the full width of the latent image may be developed. Furthermore, in attempts to make inexpensive and compact electrophotographic printers and to minimize space and related costs, the location of the toner cartridge and the developer housing may be far apart.

If the contamination, particularly in the form of clothing and paper fibers, reaches the developer housing, copy quality and machine reliability suffer. Toner particles also have a tendency to adhere together into large scale clumps which ride on the top of the developer material in the developer housing negatively effecting the blending and admixing of the incoming toner.

The use of smaller carrier and toner particles, which are typical when using colored toners for color electrophotography compounds problems associated with contamination. Imperfections in color copies, such as those caused by contamination, are much more noticeable to the human eye than imperfections in monochromic copies.

The presence of contamination in development systems utilizing hybrid scavengeless development is particularly a concern. The purpose and function of scavengeless development are described more fully in, for example, U.S. Pat. No. 4,868,600 to Hays et al., U.S. Pat. No. 4,984,019 to Folkins, U.S. Pat. No. 5,010,367 to Hays, or 5,063,875 to Folkins et al. U.S. Pat. No. 4,868,600 is incorporated herein by reference. In a scavengeless development system, toner is detached from the donor roll by applying AC electric field to self-spaced electrode structures, commonly in the form of wires positioned in the nip between a donor roll and photoreceptor. This forms a toner powder cloud in the nip and the latent image attracts toner from the powder cloud thereto. Because there is no physical contact between the development apparatus and the photoreceptor, scavengeless development is useful for devices in which different types of toner are supplied onto the same photoreceptor such as in "tri-level"; "recharge, expose and develop"; "highlight"; or "image on image" color xerography. The small color toner and related carrier particles used for the implementation of these devices and the greater visual scrutiny given to color copies compound contamination problems. Furthermore, the electrode wires utilized to form the toner powder cloud are particularly susceptible to contamination in general and in particular, to fibers such as clothing and paper fibers.

The following disclosures may be relevant to various aspects of the present invention:

U.S. Pat. No. 5,200,788 Patentee: Thayer Issue Date: Apr. 6, 1993

U.S. Pat. No. 4,752,805 Patentee: Fukae et al. Issue Date: Jun. 21, 1988

U.S. Pat. No. 4,561,759 Patentee: Knott Issue Date: Dec. 31, 1985

U.S. Pat. No. 4,389,968 Patentee: Satomura Issue Date: Jun. 28, 1983

U.S. Pat. No. 4,360,944 Patentee: Iwai et al. Issue Date: Nov. 30, 1982

U.S. Pat. No. 4,319,832 Patentee: Sakamoto et al. Issue Date: Mar. 16, 1982

U.S. Pat. No. 4,054,381 Patentee: Bernhard Issue Date: Oct. 18, 1977

The relevant portions of the foregoing disclosures may be briefly summarized as follows:

U.S. Pat. No. 5,200,788 discloses a brush auger reclaim filtration assembly incorporated into an open ended chamber. The brush auger is a toner reclaim filtration device that is rotatably mounted, in the chamber, to move toner and debris along a separating screen. Also contained in the housing is a mounted transport auger that rotates as it moves the reclaimed toner to the development housing.

U.S. Pat. No. 4,752,805 discloses a device for recycling residual developer particles which are removed from a photoconductive element by a cleaning unit in an electrographic copier or printer. The device comprises a first tube connected to the cleaning unit and a second tube which is connected to the first tube and leads to the developer unit. The second tube is disposed along the developer unit. The residual particles are transferred from the cleaning device through the first tube and into the second tube. The second tube is provided with holes spaced at predetermined distances from each other. The residual particles fall through those holes and co-mingle with developer material stored in the developer unit. A second auger is disposed within the second tube to move the residual particles to the first tube.

U.S. Pat. No. 4,561,759 discloses a device for filling and filtering toner from a supply container which is placed by an operator in communication with a feed container in a photocopier. The device has a cylindrical filling opening for the feed container with a cross section such that the supply container can be inverted. The device has a filter basket disposed in the region of the filling opening which is closed from the feed container by a filter mesh. An electric vibrator is connected to the device.

U.S. Pat. No. 4,389,968 discloses a toner regenerating device with a mesh disposed in the route of the toner collected from an image bearing member. The device includes an apparatus for imparting to the collected toner through the mesh a force causing the collected toner to move along the mesh. The collected toner on the mesh containing foreign material and solidified toner is loosened so that the solidified toner is divided into fine particles. The foreign matter is caused to float up over the collected toner and prevented from passing through the mesh.

U.S. Pat. No. 4,389,968 discloses a toner transporting device for an electrophotographic copying apparatus. The device includes a transporter for carrying toner to and into a chamber through a first opening. Toner in the chamber is moved out of a second opening. An elastic plate is mounted at one of its ends for rotation within the chamber such that its opposite tip end is maintained in contact with the interior wall of the chamber except at the second chamber opening.

U.S. Pat. No. 4,319,832 discloses a cylindrical electrode disposed in a tubular housing and applied with an electric potential opposite in polarity to a charge on usable toner particles removed from the photoconductive drum. A fur brush functions to remove the toner and foreign matter from the drum and to create an air flow which carries the toner and foreign matter through a passageway defined between the housing and cylinder. The foreign matter is carried into a foreign matter chamber by centrifugal force while the toner adheres to the cylinder which is rotated in the same direction as the air flow. The toner is carried past a blade which extends closely adjacent to the cylinder into a toner recovery chamber from which it is scrapingly removed from the cylinder and recycled.

U.S. Pat. No. 4,054,381 discloses a toner filter arrangement adapted for use in a cleaning station of a xerographic reproduction machine. Foreign material and other contaminants are removed from residual toner prior to its collection in a disposable or reuse container or return to the developer station. The filter arrangement comprises a housing having an input opening through which removed toner enters and an output opening through which filtered toner exits. The housing includes a spiral brush mounted for rotation on a shaft centrally located within the housing and a stationary open mesh screen coaxially located with respect to the shaft. Rotation of the brush operates to sift toner through the screen to the outlet of the filter housing.

SUMMARY OF THE INVENTION

According to the present invention, there is provided an apparatus for filtering contaminants from marking particles within a conduit. The apparatus includes a mover for moving the marking particles in the conduit and a screen positioned adjacent the conduit so that the marking particles pass through the screen. The apparatus also includes an applicator for applying an electrical bias between the mover and the screen to facilitate the passage of marking particles through the screen.

According to the present invention there is further provided a printing machine of the type having a developer unit adapted to develop with marking particles a latent image. The machine includes a conduit and a mover for moving the marking particles in the conduit. The machine further includes a screen positioned adjacent the conduit so that the marking particles pass therethrough and an applicator for applying an electrical bias between the mover and the screen to facilitate the passage of marking particles therethrough.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 3 printing machine will be shown hereinafter schematically and their operation described briefly with reference thereto.

Figure 3:
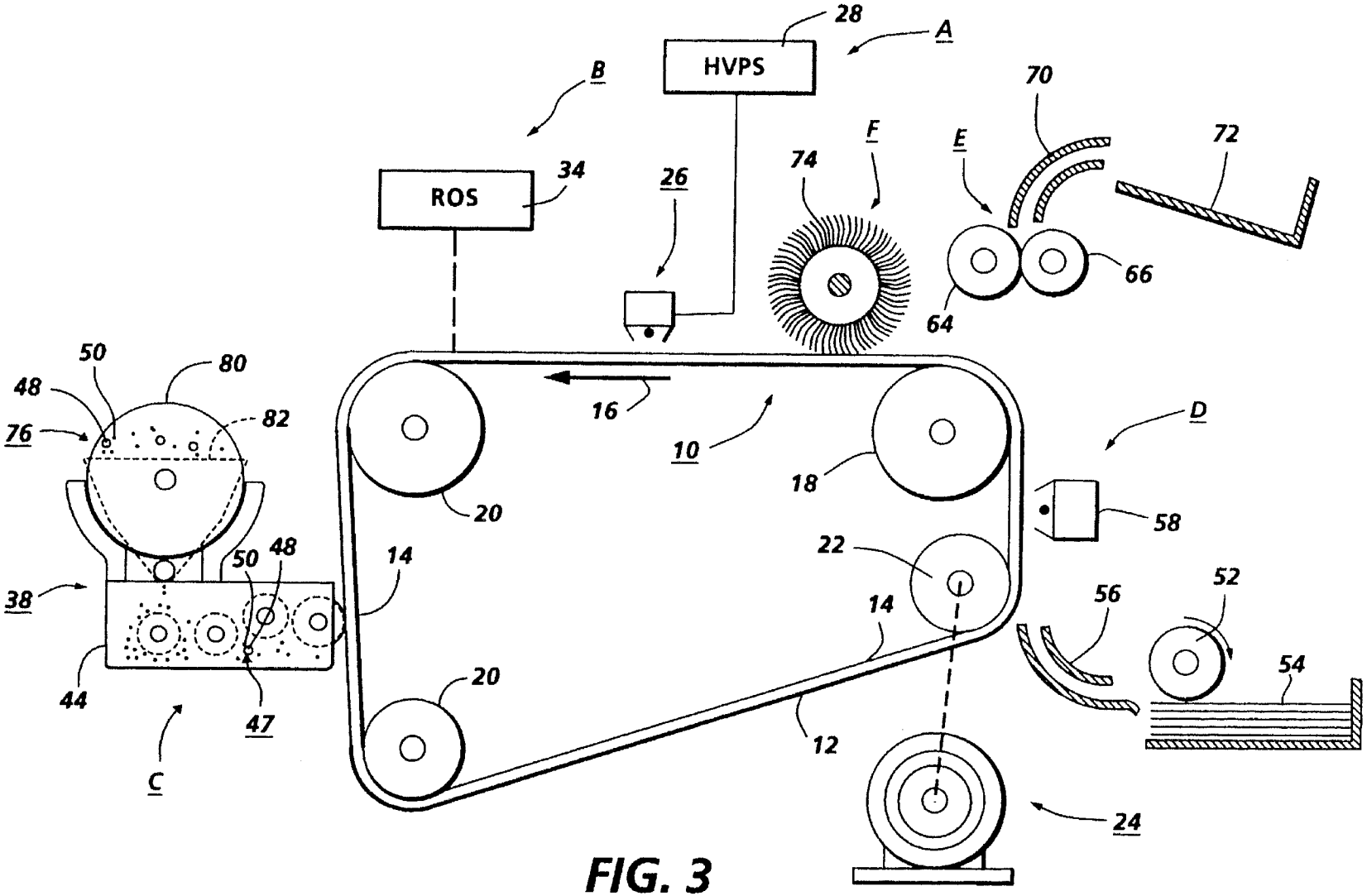
FIG. 3 is a schematic elevational view of an illustrative electrophotographic printing machine incorporating the wire mesh filter of the development apparatus of the present invention therein.

Referring initially to FIG. 3, there is shown an illustrative electrophotographic printing machine incorporating the development apparatus of the present invention therein. The printing machine incorporates a photoreceptor 10 in the form of a belt having a photoconductive surface layer 12 on an electroconductive substrate 14. Preferably, the surface 12 is made from a selenium alloy or a suitable photosensitive organic compound. The substrate 14 is preferably made from a polyester film such as Mylar® (a trademark of Dupont (UK) Ltd.) which has been coated with a thin layer of aluminum alloy which is electrically grounded. The belt is driven by means of motor 24 along a path defined by rollers 18, 20 and 22, the direction of movement being counterclockwise as viewed and as shown by arrow 16. Initially a portion of the belt 10 passes through a charge station A at which a corona generator 26 charges surface 12 to a relatively high, substantially uniform, electrical potential. A high voltage power supply 28 is coupled to device 26.

Next, the charged portion of photoconductive surface 12 is advanced through exposure station B. At exposure station B, the ROS 34 lays out the image in a series of horizontal scan lines with each line having a specified number of pixels per inch. The ROS includes a laser and a rotating polygon mirror block associated therewith. The ROS exposes the charged photoconductive surface of the printer.

After the electrostatic latent image has been recorded on photoconductive surface 12, the motion of the belt 10 advances the latent image to development station C as shown in FIG. 3. At development station C, a development system 38, develops the latent image recorded on the photoconductive surface. The chamber in developer housing 44 stores a supply of developer material 47. The developer material 47 may be, as shown in FIG. 3, a two component developer material of at least magnetic carrier granules 48 having toner particles 50 adhering triboelectrically thereto. It should be appreciated that the developer material may likewise comprise a one component developer material consisting primarily of toner particles.

Again referring to FIG. 3, after the electrostatic latent image has been developed, the motion of the belt 10 advances the developed image to transfer station D, at which a copy sheet 54 is advanced by roll 52 and guides 56 into contact with the developed image on belt 10. A corona generator 58 is used to spray ions on to the back of the sheet so as to attract the toner image from belt 10 to the sheet. As the belt turns around roller 18, the sheet is stripped therefrom with the toner image thereon.

After transfer, the sheet is advanced by a conveyor (not shown) to fusing station E. Fusing station E includes a heated fuser roller 64 and a back-up roller 66. The sheet passes between fuser roller 64 and back-up roller 66 with the toner powder image contacting fuser roller 64. In this way, the toner powder image is permanently affixed to the sheet. After fusing, the sheet advances through chute 70 to catch tray 72 for subsequent removal from the printing machine by the operator.

After the sheet is separated from photoconductive surface 12 of belt 10, the residual developer material adhering to photoconductive surface 12 is removed therefrom at cleaning station F by a rotatably mounted fibrous brush 74 in contact with photoconductive surface 12. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the development apparatus of the present invention therein.

Figure 4:
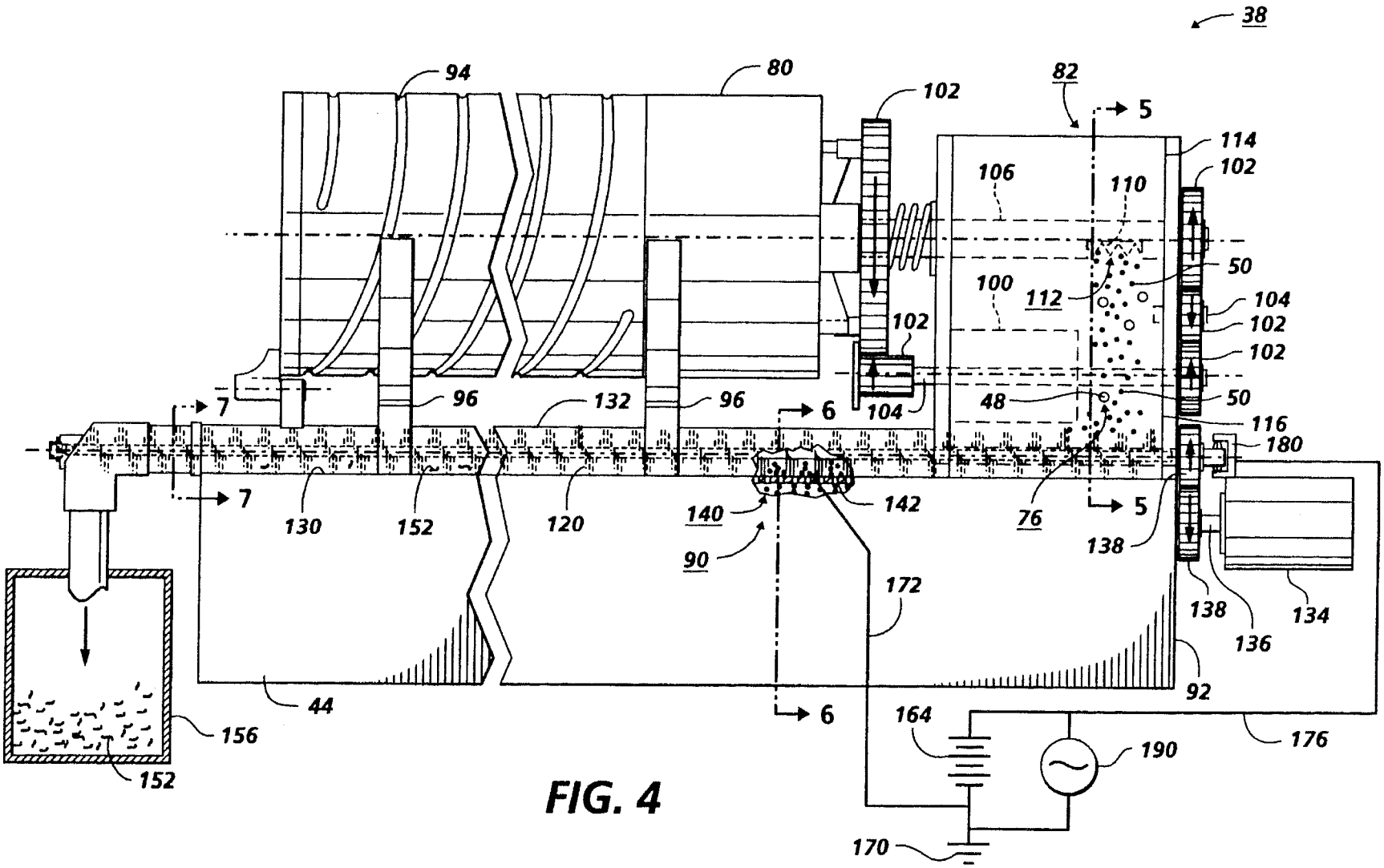
FIG. 4 is an elevational view of a development housing partially in section including a wire mesh filter according to the present invention.

Referring again to FIG. 3, in order to provide a constant supply of at least toner 50 to replace that consumed in the developing of the latent image, the development system 38 includes a cartridge 80 for storing a replaceable supply of replenisher 76 including at least toner 50. The replenisher 76 may contain carrier granules 48 as well as toner particles 50 in order to replace worn and broken carrier granules 48 as shown in FIG. 3. It should be appreciated however that the invention may be practiced with the replenisher including only toner. As the typical usage of toner is larger than the typical usage of carrier granules (on a weight basis) whether on a per copy or per hour basis, the ratio of toner to carrier in the cartridge is much larger than the ratio of toner to carrier in the housing. The use of replenisher containing carrier particles as well as toner is disclosed in U.S. Pat. No. 4,614,165 to Folkins et al. herein incorporated by reference. The cartridge 80 is a replaceable item that can be made of any suitable durable material and may be vertically oriented with its opening pointed downward whereby it may be emptied by gravity. Where, however, space constraints become a problem, the cartridge 80 may include a device (not shown) for extracting the developer material from the cartridge 80. Particles in the toner cartridge 80 progress to a toner sump or developer sump 82 as shown in FIG. 4. While the sump 82 may ideally be located above the development housing 44 whereby gravity may feed the replenisher 76 from the sump 82, where, as earlier stated, space constraints for the toner cartridge 80, sump 82, and developer housing 44 become a concern, the sump 82 may not be located above the development housing 44.

Referring now to FIG. 4, according to the present invention, electrically biased toner filter 90 is shown as part of the development system 38. It should be appreciated that the point of use toner filter 90 is adaptable to development system utilizing toner or developer. The development system 38 shown in FIG. 4 represents a typical development system for providing toner from the toner cartridge 80 to the latent image 10 (see FIG. 3).

It should also be appreciated that the copy machine may also include a cleaning system (not shown) as a part of the cleaning station F (see FIG. 3) in which toner not used in the development process may be recycled for use in the developer system 38. It should also be appreciated that the toner suppled by the cleaning system may alternatively or in addition to be filtered by the electrically biased toner filter 90.

Referring again to FIG. 4, the development system 38 includes the developer housing 44 which supports the remainder of the development system 38. The sump 82 is located above and near a first end 92 of the developer housing 44. The sump 82 receives replenisher 76 from the toner cartridge 80 and stores a supply of the replenisher 76 for later delivery to the developer housing 44. The developer housing 44 also supports the toner or developer cartridge 80. The toner cartridge 80 preferably is a cylindrical cartridge with a spiral rim 94 formed therein. It should be appreciated, however, that the cartridge 80 may likewise be vertically located whereby gravity is used to urge the replenisher 76 toward the developer housing 44. The cartridge 80 is rotated about supports 96 by means of a motor 100. Gears 102 and shafts 104 are used to translate the torque from the motor 100 to the cartridge 80. A conduit or tube 106 extends from the interior of the cartridge 80 to the interior of the development sump 80. A spiral auger 110 is located within the tube 106 and is likewise rotated by the motor 100 via the gears 102 and the shafts 104. Replenisher 76 from the cartridge 80 enters the tube 106 and is drawn by the auger 110 into the sump 82 and released into the sump 82 at an opening 112 in the sump 82.

Figure 5:
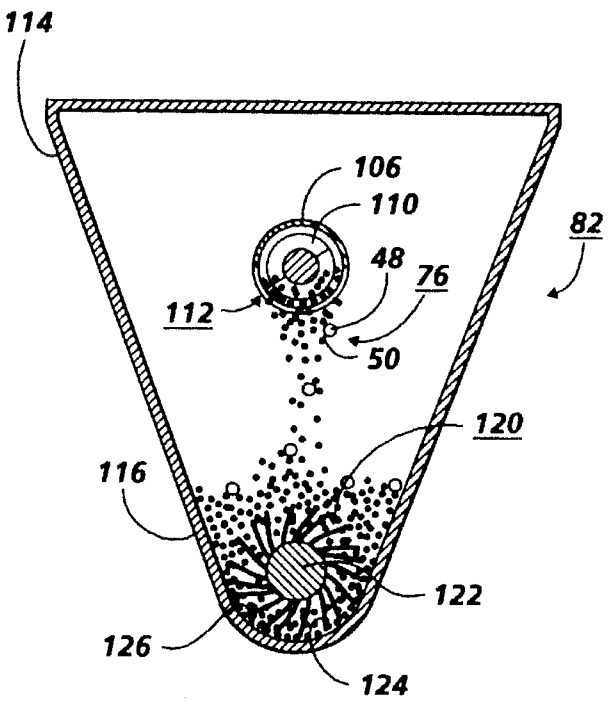
FIG. 5 is a partial sectional view through section 5—5 of FIG. 4.

Now referring to FIG. 5, the sump 82 is shown in greater detail. The sump 82 has a V-shaped cross section with a wide upper portion 114 and a narrow lower portion 116. The tube 106 extends into the upper portion 114 of the sump 82 and the auger 110 is slidably fit therewithin and rotates relative to the tube 106. The replenisher 76 after being drawn through the tube 106 by the auger 110 is dispelled through the opening 112 in the lower portion 116 of the tube 106. The replenisher 76 falls by gravity to the lower portion 116 of the sump 82. A brush auger 120 is matingly supported by the sump 82. The brush auger 120 may take on any suitable form, but preferably includes a shaft 122 preferably made of a durable material such as a metal, for example, steel. Bristles 124 extend outwardly from the shaft 122 in a radial direction. The bristles 124 extend outwardly to periphery 126 of the sump 82.

Referring again to FIG. 4, the brush auger 120 extends from the sump 82 along top 130 of developer housing 44. Outside the sump 82, the auger 120 is supported by and contained within a conduit 132. The conduit 132 may be a separate component or, as shown in FIG. 4, may be an integral part of the developer housing 44. To permit the replenisher 76 to progress along the brush auger 120, a brush auger motor 134 is operatively connected to auger 120 by means of shafts 136 and gears 138. The replenisher 76, which falls by gravity to the lower portion 116 of the develop sump 82, is carried by the auger 120 from the sump 82 along the conduit 132. An aperture 140 in the form of an opening is located in the conduit 132 adjacent the developer housing 44 to permit the replenisher 76 to progress from the conduit 132 to the developer housing 44. A screen 142 is placed in the opening 140 to permit the passage therethrough of the replenisher 76 while preventing contaminants from entering the developer housing 44.

Figure 1:
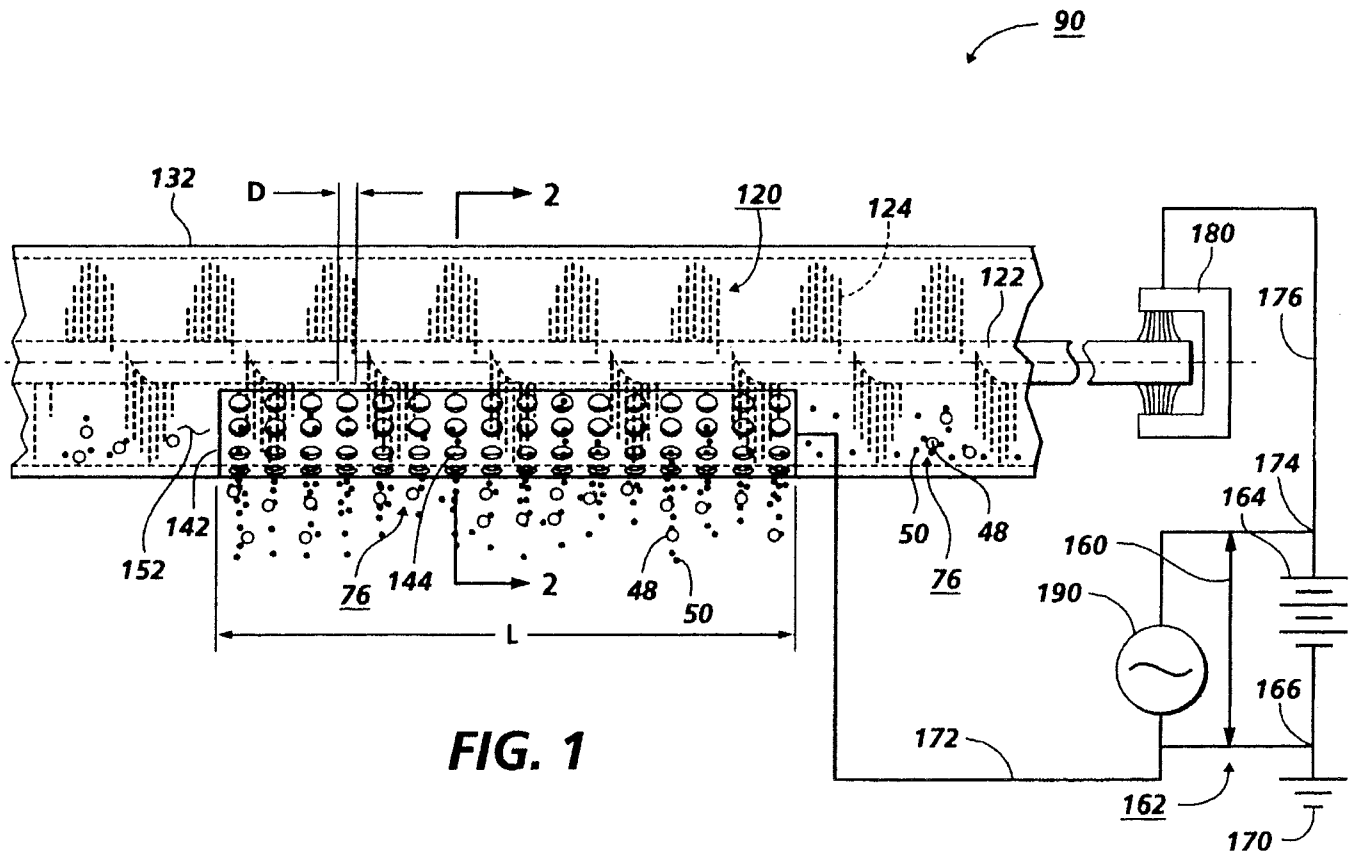
FIG. 1 is a schematic partial elevational view of the development housing, partially in section, including a wire mesh filter according to the present invention.

The screen 142 is shown in more detail in FIG. 1. The opening 140 is located above the developer housing 44 in a location most suitable for the proper filling of the developer housing 44 and to optimize the mixing of the replenisher 76 with the developer material 47 within the developer housing 44. The screen 142 may be integral with the conduit 132, or as shown in FIG. 1, be a separate piece. The screen 142 preferably covers the entire opening 140. The screen 142 includes a large quantity of small apertures 144 through which the replenisher 76 may pass. Since the average carrier granule diameter is approximately 40 microns, the aperture size must have a diameter of at least 40 microns. It should be appreciated that the toner filter 90 may include solitary screen 142 as shown in FIG. 1, or alternatively include a plurality of screens spaced apart along the conduit 132. In order to provide proper interaction between the bristles 124 and the screen 142, the screen 142 has a shape which conforms to the bristles 124 of the auger 120. The screen 142 has a arcuate shape, for example the shape of a portion of a cylinder. Preferably, an inner periphery 146 of the screen 142 is contiguous with an inner periphery 148 of the conduit 132.

The screen 142 may be made of any suitable durable material such as a metal, or a natural or synthetic material. For example, the screen 142 may be made of a cotton or a polymer. For example, the screen 142 may be made of wire mesh. The screen 142 may be secured to the conduit 132 by any suitable means such as by welding or by fasteners (not shown).

Figure 2:
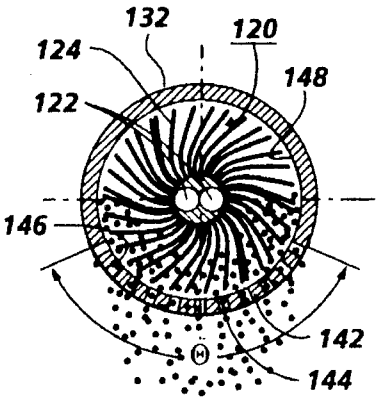
FIG. 2 is a partial sectional view through section 2—2 of FIG. 1.

Now referring to FIG. 2, the brush auger 120 is shown in more detail. The shaft 122 may have any suitable shape. The shaft 122 may be made of any suitable durable material such as a carbon graphite material or a metal. For example, the shaft 122 may be made of a pair of steel wires twisted together. The bristles 124 which extend from the shaft 122 may be secured to the shaft 122 by any suitable means such as gluing, but preferably, the bristles 124 extend between the pair of steel wires and are appropriately secured therebetween. The bristles 124 may be made of any suitable flexible material such as Nylon® (a trademark of DuPont (UK) Ltd.). Preferably, the fiber bristles 124 extend outwardly to the inner peripheries 146 and 148 of the screen 142 and the conduit 132, respectively. Preferably, the bristles 124 are so long that they bend between the shaft 122 and the periphery 146 of the screen 142.

Referring again to FIG. 1, a length L and an angle of wrap $\alpha$ (see FIG. 2) the screen 142 and the diameter D of the apertures 144 determine the quantity of replenisher 76 carried by the auger 120 which may pass through the screen 142 during its trip along the auger 120.

Figure 6:
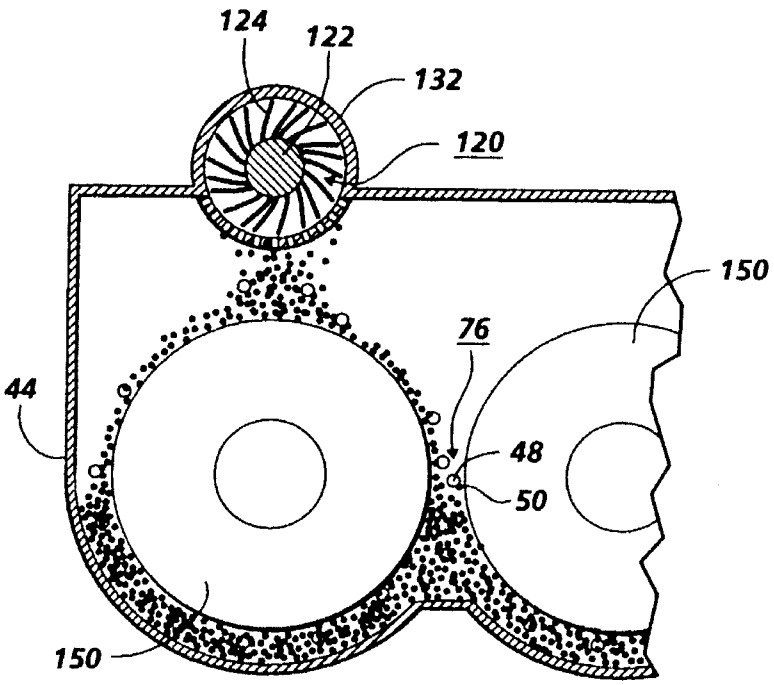
FIG. 6 is a partial sectional view through section 6—6 of FIG. 4.

Now referring to FIG. 6, the replenisher 76 which passes through the screen 142 enters the developer housing 44 and passes onto mixing augers 150 which mix the developer material in the developer housing 44.

Figure 7:
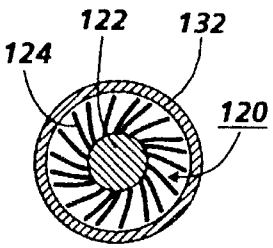
FIG. 7 is a sectional view through section 7—7 of FIG. 4.

Referring again to FIG. 4, contaminants 152 which do not pass through the screen 142 progress along the conduit 132 being carried by the auger 120 (see FIG. 7).

Contaminants 152 which progress past end 154 of the conduit 132, progress into waste container 156 where the contaminants 152 accumulate for later removal therefrom.

Referring again to FIG. 1, in order to significantly improve the efficiency of the toner filter 90, an electrical bias 160 may optionally be placed between the screen 142 and the shaft 122 of the auger 120. For proper operation of a toner filter 90 with electrical bias 160, the auger shaft 120 and at least a portion of the screen 142 must be made from an electrically conductive material, such as a metal. For example, the shaft 122 may be made of steel and the screen 142 may be made of a wire mesh. Alternatively the screen may be made of carbon doped cotton or a conductive synthetic. Further for proper operation of toner filter 90 with electrical bias 160, the bristles 124 should be made of a non-conductive material, such as a plastic, such as Nylon® (a trademark of DuPont (UK) Ltd.).

The toner filter 90 with the bias 160 includes a power source 162. The power source 162 includes a d.c. power source 164. The d.c. power source 164 may be any suitable commercially available power source with an output of approximately 1,000 volts d.c. A first terminal 166 of the d.c. power source is attached to ground 170 and to the screen 142 by a first electrical conduit 172. A second terminal 174 of the d.c. power source 164 is connected to the auger 120 by a second electrical conduit 176 and a brushes 180. The brushes 180 permits electrical contact to the shaft 122 during its rotation.

The replenisher 76 carried along by the auger 120 in a two component development system includes the carrier granules 48 and toner particles 50. The d.c. power source 164 provides a field gradient between the shaft 122 and the screen 142. The field gradient around the shaft 122 attracts the contaminants 152 such as cloth or paper fibers toward the shaft 122 and away from the screen 142. The toner particles 50 which are too small to respond to the field gradient fall through the screen 142. The carrier granules 48 are too heavy to be lifted to the auger shaft 122, and, therefore, fall through the screen provided that the screen pore size D is large enough. For a toner filter 90 with the electrical bias 160, the diameter D of the apertures 144 in the screen 142 may be as large as 500 microns and still provide effective filtering of contaminants 152 while allowing carrier granules 48 to pass through unimpeded. The length L and the angle of wrap $\alpha$ of the screen 142 may need to be larger to pass the same amount of replenisher 76 through the screen 142 than in a toner filter 90 without the electrical bias 160.

To insure that only dipole forces and not Coulomb forces are driving the particles, an a.c. power source 190 may also be included in the power source 162.

It should be appreciated that with the use of the bias 160, the biasing forces may contribute very significantly to separate the replenisher 76 from the contamination 152, therefore, the screen 142 may be alternatively a flat plate which would have less mechanical contact with the brush and reduced mechanical separation. In may even be conceivable to have no contact between the screen and the brush and rely solely on the biasing forces for the filtration. It should be further appreciated that the toner filter 90 may be located elsewhere in the machine such as in the waste toner system (not shown) for filtering waste toner or be used to filter toner or replenisher during the manufacture thereof.

The use of the electrical bias improves the filtering efficiency of toner passing through the toner filter for filtration of contaminants whether the contaminants are in waste toner, in toner being manufactured, in toner in the toner cartridge, or in toner in the development system between the cartridge and the developer housing.

The use of an electrically biased filter including a brush type auger efficiently removes cloth fibers and paper fibers which negatively affect image quality and machine reliability.

The use of an electrically biased brush type auger and filter screen prevent large scale clumps of developer material from entering the developer housing and negatively affecting the blending and admixing of the toner.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

We claim:

1. An apparatus for filtering contaminants from marking particles within a conduit, comprising:

means for moving the marking particles in the conduit;

a screen positioned adjacent the conduit so that the marking particles pass therethrough; and means for applying an electrical bias between said moving means and said screen to facilitate the passage of marking particles therethrough.

2. An apparatus according to claim 1, wherein said screen comprises an electrically conductive material.

3. An apparatus according to claim 1, wherein said moving means comprises an elongated member mounted rotatably in said conduit.

4. An apparatus according to claim 3, wherein said elongated member comprises an electrically conductive shaft.

5. An apparatus as in claim 3, wherein said elongated member further comprises a plurality of pliant elements extending outwardly from said shaft in an at least partially spiral pattern and closely conforming to said conduit.

6. An apparatus as in claim 5, wherein said pliant elements extend outwardly from said elongated member in a helical pattern.

7. An apparatus as in claim 5, wherein said pliant elements comprise an electrically nonconductive material.

8. An apparatus as in claim 3, further comprising means, operably associated with said elongated member, for rotating said elongated member.

9. An apparatus as in claim 3, wherein said electric bias applying means comprises means for applying a DC voltage to said elongated member.

10. An apparatus as in claim 9, wherein said electric bias applying means further comprises means for applying an AC voltage to said elongated member.

11. A printing machine of the type having a developer unit adapted to develop with marking particles a latent image, comprising:

a conduit;

means for moving the marking particles in said conduit;

a screen positioned adjacent said conduit so that the marking particles pass therethrough; and means for applying an electrical bias between said moving means and said screen to facilitate the passage of marking particles therethrough.

12. A printing machine according to claim 11, wherein said screen comprises an electrically conductive material.

13. A printing machine according to claim 11, wherein said moving means comprises an elongated member mounted rotatably in said conduit.

14. A printing machine according to claim 13, wherein said elongated member comprises an electrically conductive shaft.

15. A printing machine as in claim 13, wherein said elongated member further comprises a plurality of pliant elements extending outwardly from said shaft in an at least partially spiral pattern and closely conforming to said conduit.

16. A printing machine as in claim 15, wherein said pliant elements extend outwardly from said elongated member in a helical pattern.

17. A printing machine as in claim 15, wherein said pliant elements comprise an electrically nonconductive material.

18. A printing machine as in claim 13, further comprising means, operably associated with said elongated member, for rotating said elongated member.

19. A printing machine as in claim 13, wherein said electric bias applying means comprises means for applying a DC voltage to said elongated member.

20. A printing machine as in claim 19, wherein said electric bias applying means further comprises means for applying an AC voltage to said elongated member.

* * * * *